US009102464B2

(12) United States Patent
Simanski

(10) Patent No.: US 9,102,464 B2
(45) Date of Patent: Aug. 11, 2015

(54) COFFEE CAPSULE WITH A DEFORMABLE SEALING ELEMENT

(75) Inventor: Bernd Simanski, Iserlohn (DE)

(73) Assignee: Nestec S.A., Vevey (CH)

( * ) Notice: Subject to any disclaimer, the term of this patent is extended or adjusted under 35 U.S.C. 154(b) by 1386 days.

(21) Appl. No.: 12/302,565

(22) PCT Filed: May 23, 2007

(86) PCT No.: PCT/EP2007/054986

§ 371 (c)(1),
(2), (4) Date: Jul. 1, 2009

(87) PCT Pub. No.: WO2007/137974

PCT Pub. Date: Dec. 6, 2007

(65) Prior Publication Data

US 2009/0320692 A1 Dec. 31, 2009

(30) Foreign Application Priority Data

May 29, 2006 (CH) ..... 864/06

(51) Int. Cl.
*A47J 31/00* (2006.01)
*B65D 85/804* (2006.01)

(52) U.S. Cl.
CPC ..... *B65D 85/8043* (2013.01)

(58) Field of Classification Search
CPC ..... B65D 85/804; B65D 85/8046; B65D 85/8043; A47J 31/02
USPC ..... 99/279, 295, 302 R, 323, 289, 289 R, 99/275; 426/432, 433, 77, 78, 79, 82; 206/0.5; 277/626, 644
See application file for complete search history.

(56) References Cited

U.S. PATENT DOCUMENTS

| | | | | | |
|---|---|---|---|---|---|
| 2,365,574 | A | * | 12/1944 | McWane | 277/625 |
| 2,753,074 | A | * | 7/1956 | Schmid | 220/235 |
| 3,561,349 | A | * | 2/1971 | Endo et al. | 99/307 |
| 4,136,202 | A | * | 1/1979 | Favre | 426/77 |
| 4,541,537 | A | * | 9/1985 | Sailor | 215/274 |
| 4,846,052 | A | * | 7/1989 | Favre et al. | 99/295 |
| 5,402,707 | A | * | 4/1995 | Fond et al. | 99/295 |

(Continued)

FOREIGN PATENT DOCUMENTS

| | | |
|---|---|---|
| EP | 512 470 B1 | 11/1992 |
| EP | 1 654 966 A1 | 5/2006 |

(Continued)

OTHER PUBLICATIONS

International Search Report PCT/EP20007/054986 Dated Dec. 4, 2007.

*Primary Examiner* — Tu B Hoang
*Assistant Examiner* — Alba Rosario-Aponte
(74) *Attorney, Agent, or Firm* — K&L Gates LLP

(57) ABSTRACT

A portion packaging for receiving a substance to produce a drink. This packaging includes a curved base, a transition region integrally formed in this base, a side wall which is integrally formed on this transition region and extends conically, and an edge which is integrally formed on this side wall and protrudes outwardly. The base, the transition region and the side wall form a cavity for receiving the substance. The cavity has an opening which is closable with a film. A deformable sealing element is arranged on the portion packaging. Also, a device for producing a drink by extraction of same from a substance contained in a portion packaging.

17 Claims, 3 Drawing Sheets

(56) References Cited

U.S. PATENT DOCUMENTS

| | | | | |
|---|---|---|---|---|
| 5,472,719 | A * | 12/1995 | Favre | 426/77 |
| 5,656,311 | A * | 8/1997 | Fond | 426/84 |
| 5,656,316 | A * | 8/1997 | Fond et al. | 426/433 |
| 5,897,899 | A * | 4/1999 | Fond | 426/112 |
| 6,026,732 | A * | 2/2000 | Kollep et al. | 99/295 |
| 6,758,130 | B2 * | 7/2004 | Sargent et al. | 99/295 |
| 7,993,691 | B2 * | 8/2011 | Yoakim et al. | 426/77 |
| 2006/0110507 | A1 * | 5/2006 | Yoakim et al. | 426/433 |
| 2006/0280841 | A1 * | 12/2006 | Cai | 426/77 |
| 2007/0144355 | A1 * | 6/2007 | Denisart et al. | 99/275 |
| 2007/0224319 | A1 * | 9/2007 | Yoakim et al. | 426/433 |
| 2009/0004335 | A1 * | 1/2009 | MacMahon et al. | 426/78 |
| 2009/0280219 | A1 * | 11/2009 | Yoakim et al. | 426/77 |

FOREIGN PATENT DOCUMENTS

| | | | | |
|---|---|---|---|---|
| EP | 1654966 | A1 * | 5/2006 | B65D 85/804 |
| FR | 2 617 389 | | 1/1989 | |
| JP | 20042440785 | | 9/2004 | |
| WO | WO 2006/045515 | | 5/2006 | |

* cited by examiner

COFFEE CAPSULE WITH A DEFORMABLE SEALING ELEMENT

This application is a 371 filing of International Patent Application PCT/EP2007/054986 filed May 23, 2007.

TECHNICAL FIELD OF THE INVENTION

The present invention relates to a portion packaging with a deformable sealing element.

PRIOR ART

The prior art discloses a multiplicity of such portion packagings and devices for the extraction of a drink. For example, EP 0 512 470 discloses a portion packaging for producing a drink with a corresponding device.

However, many portion packagings and their associated devices have the disadvantage that the tightness between portion packaging and device cannot always be ensured. This has a disadvantageous effect on the quality of the drink to be prepared.

SUMMARY OF THE INVENTION

It is an object of the invention to design a portion packaging and a device for producing a drink in such a manner that high fluid tightness between portion packaging and device can be produced, and that the portion packaging can be used with devices of the prior art.

It is a further object of the invention that only the portion packaging designed according to the invention and not portion packagings of the prior art can be used in the device according to the invention.

A portion packaging with the features of Patent claim 1 achieves this object. Advantageous refinements of the invention are indicated in the dependent claims.

A portion packaging for receiving a substance generally comprises a curved base and a transition region integrally formed on this base, a side wall which is integrally formed on this transition region and extends conically, and an edge which is integrally formed on this side wall and protrudes outwards and which can also be referred to as a flange. The base, the transition region and the side wall form a cavity for receiving a substance, in particular coffee. The cavity has an opening which is closable with a film and is used for pouring in the substance, such as, for example, coffee powder. According to the invention, a deformable sealing element is integrally formed on the portion packaging.

The deformable sealing element can be deformed by means of a holding-down device and/or a counterpart of a corresponding extraction device before and/or during an extraction operation. The deformation is such that a fluid-tight contact can be produced between the holding-down device, the counterpart and the sealing element.

The fluid-tight contact permits a drink to be extracted from a substance under high pressure. This is particularly advantageous if, for example, a coffee drink is to be extracted from ground coffee.

The deformation or squeezing of the sealing element has the advantage over a different type of deformation, such as, for example, a resilient deformation of a sealing element, that greater tightness is achieved between capsule and holding-down device.

When the holding-down device is closed, there is a spacing between a lower edge of the holding-down device and the protruding edge of the portion packaging. The spacing preferably has a height of 0.05 mm to 0.5 mm. The height extends from the surface of the protruding edge as far as the lower edge of the holding-down device.

A spacing of this type has the advantage that the pressure arising during the extraction can spread as far as the sealing point.

The sealing element is preferably arranged essentially on the outer border of the protruding edge and is in the form of a rollover edge.

An arrangement and configuration of this type makes it possible for a portion packaging according to the present invention to be produced in a particularly simple and therefore cost-effective manner.

The rollover edge essentially has an elliptical or oval cross-sectional shape. The rollover edge is integrally formed with a first region on the outer border of the protruding edge. The first region has a rounded shape and protrudes downwards, i.e. in the direction of the counterpart. A second region is integrally formed on the first region in such a manner that the second region is arranged essentially at right angles to the surface of the protruding edge. A third region is integrally formed on the second region, the third region having a rounded shape. A fourth region is integrally formed on the third region and extends essentially parallel to the second region. The fourth region can in this case be connected to the outer border of the protruding edge or can be free-standing or can be rolled inwards, the free end then being surrounded by the four regions.

Alternatively, the first region can also protrude upwards, i.e. away from the counterpart. The configuration of the second region, the third region and the fourth region are designed in the same manner as described above.

The rollover edge with the elliptical or round cross section extends preferably up to 1/3 downwards from the protruding side edge, i.e. in the direction of the counterpart, and up to 2/3 upwards, i.e. away from the counterpart. Other ratios are, of course, also possible, in particular it is conceivable for the ratio to be 1:1. However, the ratio may also be 1/5 to 4/5.

The rollover edge preferably has a height of 0.5 mm to 2.5 mm. A height of 1.0 mm to 1.8 mm is particularly preferred. The width of the rollover edge preferably lies in the range of from 0.3 mm to 0.8 mm. A width of 0.5 mm to 0.7 mm is particularly preferred.

The distance from the side wall as far as the rollover edge, which distance essentially corresponds to the width of the protruding edge or flange, is preferably between 1 mm and 5 mm. A distance of 1.5 mm and 3 mm is particularly preferred.

In particular, the second region, the third region and the fourth region can be deformed by a corresponding sealing region of the holding-down device.

This elliptical or oval cross-sectional shape can be deformed particularly readily and a good sealing action can be obtained, which has a positive effect on the extraction operation.

The height of the rollover edge is preferably greater than the width of the rollover edge, with the height extending in the direction of actuation of the holding-down device.

During the deformation operation, the fourth region can be conducted into the inside of the rounded shape of the first region. This brings about a particularly good sealing action. In the process, the rollover edge is deformed, i.e. irreversibly deformed or squeezed. In this case, a complete return of the rollover edge into its original form after the holding-down device is removed is impossible. However, it is also possible for the deformation of the rollover edge or of the sealing element to be only partially plastic. In this case, the deformation accordingly has a plastic and also an elastic component.

Parts of the rollover edge can therefore return into their original form after the holding-down device is removed.

Furthermore, it is possible for the rollover edge which is integrally formed on the outer border of the protruding region to only have one region. This region essentially assumes a round cross-sectional shape. A spiral cross-sectional shape is also conceivable.

In addition, the sealing element can be arranged on the side wall and can be essentially configured as a bead.

Furthermore, the sealing element can be arranged on the protruding side edge and can be essentially configured as a bead.

The portion packaging is preferably produced from aluminium or an aluminium alloy. In addition, the portion packaging can be provided on its inside and/or outside with a layer composed of plastic or of other materials.

In general, the sealing element can be made of aluminium and/or plastic and/or rubber-elastic material. In that case, the portion packaging can partially or entirely be made of plastic material. For instance, the sealing element can be made of an aluminium support and a rubber-elastic external lining that improves fluid tightness.

The portion packaging preferably has an average wall thickness of 0.05 mm to 0.12 mm. An average wall thickness of 0.07 mm to 0.10 mm is particularly preferred.

The portion packaging is preferably produced by means of a deep-drawing process, in particular, when the portion packaging comprises aluminium or aluminium alloy. This permits efficient and cost-effective production of the portion packaging.

When in plastic, the portion packaging can also be produced by thermoforming or injection moulding.

A device for producing a drink by extraction of the same from a substance contained in a portion packaging, the portion packaging being insertable into the device, comprises at least one holding-down device and a counterpart with a punching plate. The holding-down device and/or the counterpart are equipped with means for the sealing deformation of parts of the portion packaging. A depression which is complementary to the sealing element is arranged in a lower region of the holding-down device and/or a depression which is complementary to the sealing element is arranged in the counterpart. However, the depressions can also be arranged just on one of the two elements, i.e. either on the holding-down device or on the counterpart. The sealing therefore takes place without additional elements, such as, for example, a rubber ring, etc.

BRIEF DESCRIPTION OF THE FIGURES

The invention is described in more detail below with reference to the drawing, in which.

DESCRIPTION OF AN EXEMPLARY EMBODIMENT

Figure 1:
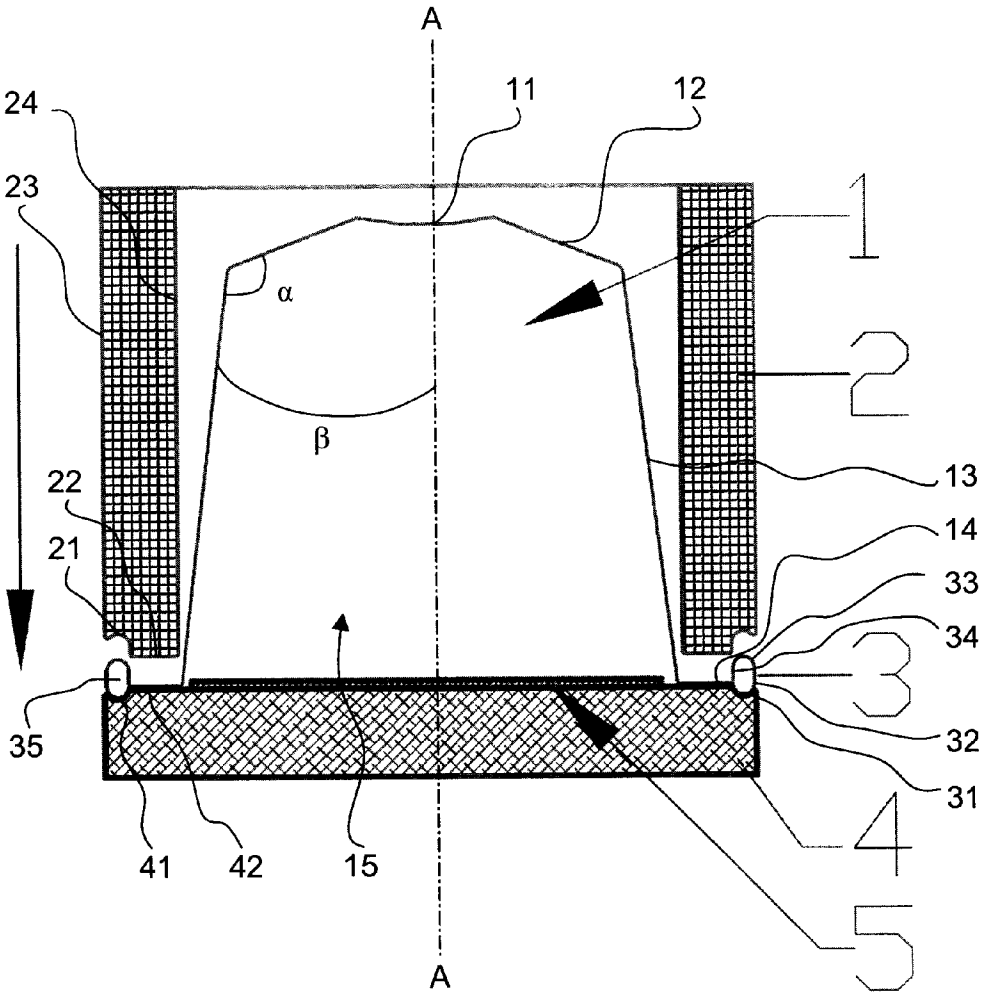
FIG. 1 shows an exemplary embodiment of a portion packaging and elements of a device according to the present invention before the extraction operation.

An example of a portion packaging according to the present invention and elements of an example of a device according to the present invention are shown in FIG. 1. The portion packaging is shown here as a coffee capsule 1.

The coffee capsule 1 serves to receive ground coffee for the preparation of a coffee drink. A transition region 12 is integrally formed on a curved base 11. A side wall 13 is integrally formed on the transition region 12. An outwardly protruding edge 14 is integrally formed on the side wall 13. The outwardly protruding edge 4 is configured in the shape of a circular disc ring and has a planar surface. The outwardly protruding edge 14 may also be referred to as a flange. The base 11, the transition region 12 and the side wall 13 form a cavity 15 with an opening. The cavity 15 serves to receive the substance, here coffee powder, which can be poured through the opening. The opening is closable with a film. Furthermore, a deformable sealing element 3 is arranged on the portion packaging, in the preferred exemplary embodiment the sealing element 3 is arranged on the outside of the protruding edge 14. The portion packaging is configured in a rotationally symmetrical manner with respect to a central axis A-A.

In the present exemplary embodiment, the curvature of the curved base extends into the cavity 15.

In the present exemplary embodiment, the sealing element 3 is configured as a rollover edge which essentially has an elliptical or oval cross-sectional shape. The rollover edge is integrally formed with a first region 31 on the outer border of the protruding edge 14. The first region 31 in cross section has a rounded shape which is essentially semicircular. The first region extends downwards from the protruding edge 14.

A second region 32 which extends essentially at right angles to the surface of the protruding edge 14 is integrally formed on the first region 31. In addition, the second region 32 extends over the protruding edge 14. Accordingly, part of the rollover edge extends below the protruding edge 14 while another part of the rollover edge extends above the protruding edge 14.

A third region 33 is integrally formed on the second region 32. The third region 33 in cross section has a rounded cross-sectional shape which is essentially semicircular.

A fourth region 34 is integrally formed on the third region 33. The fourth region 34 is essentially parallel to the second region 32. In the present exemplary embodiment, the end of the fourth region is free-standing, i.e. it is not connected to the protruding side edge 14.

In the preferred exemplary embodiment, the height of the rollover edge has a greater size than the width of the rollover edge.

A cavity 35 which is bounded by the four regions 31, 32, 33, 34 is formed by the described configuration of the rollover edge.

The device of the present invention serves to produce a drink, such as, for example, coffee. In this case, the above-described coffee capsule 1 can be inserted into the device. The device comprises at least one holding-down device 2 and a counterpart 4 with a punching plate 5 onto which the coffee capsule 1 is placed.

The holding-down device 2 is movable axially with respect to the counterpart 4 and the coffee capsule 1 placed onto it.

In the present exemplary embodiment, the holding-down device 2 has a hollow-cylindrical shape with an annular base surface with an outside 23 and an inside 24. A lower edge 22 forms a lower end of the holding-down device 2. A sealing region 21 is arranged on the lower edge 22 in the vicinity of the outside 23 and extends into the holding-down device 2. The sealing region 21 has in this case a shape which is essentially complementary to the rollover edge seal of the coffee capsule 1, and a sealing action is obtained on account of the deformation of the rollover edge and by means of the shaping of the sealing region. The sealing region 21 extends over the entire circumference of the hollow-cylindrical holding-down device 2.

The counterpart 4 has a supporting surface 42 and a depression 41. The depression 41 has a shape which is complementary to the rollover edge seal of the coffee capsule 1. The depression 41 of the counterpart 4 and the sealing region 21 of the holding-down device 2 are aligned concentrically with respect to each other.

The coffee capsule 1 is then placed onto the supporting surface 42 in such a manner that the rollover edge comes to lie in the depression 41 and that the opening which is closed with the film rests on the supporting surface 42 and on the punching plate 5. The coffee capsule 1 is now likewise concentric with respect to the depression 41 and to the sealing region 21. That is to say, the central axis of the coffee capsule, the central axis of the holding-down device and the central axis of the counterpart are concentric with respect to one another.

Figure 2:
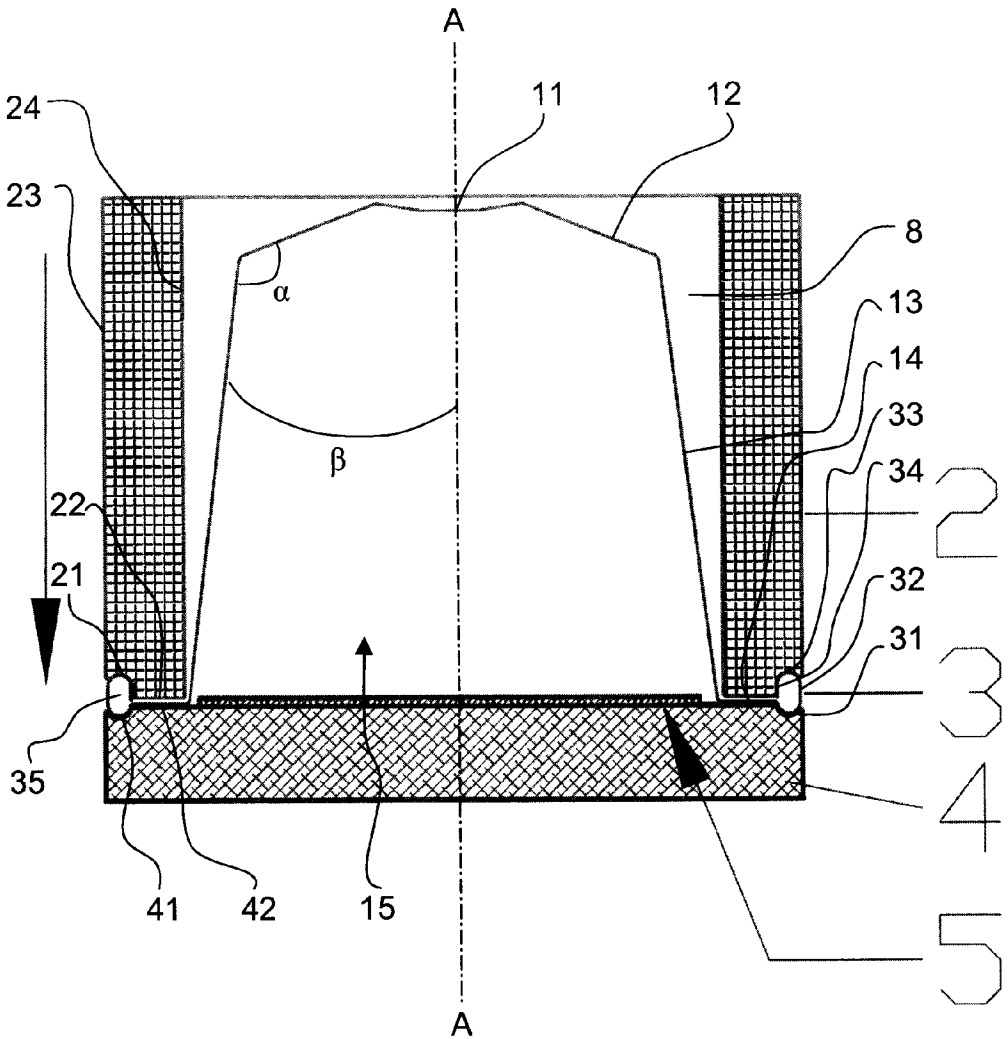
FIG. 2 shows the exemplary embodiment of FIG. 1 shortly before the extraction operation.

After a capsule is inserted, the holding-down device is moved along the central axis A-A towards the supporting surface 42. In the process, the sealing region 21 of the holding-down device strikes against the rollover edge of the capsule. This can readily be seen in FIG. 2.

The punching plate 5 serves, interalia, together with the holding-down device to deform the film which closes the cavity 15. Furthermore, there are mechanical elements which pierce the coffee capsule in the region of the base, so that the extraction fluid can penetrate the capsule. These operations are known to a person skilled in the art, and so a description thereof is superfluous.

Figure 3:
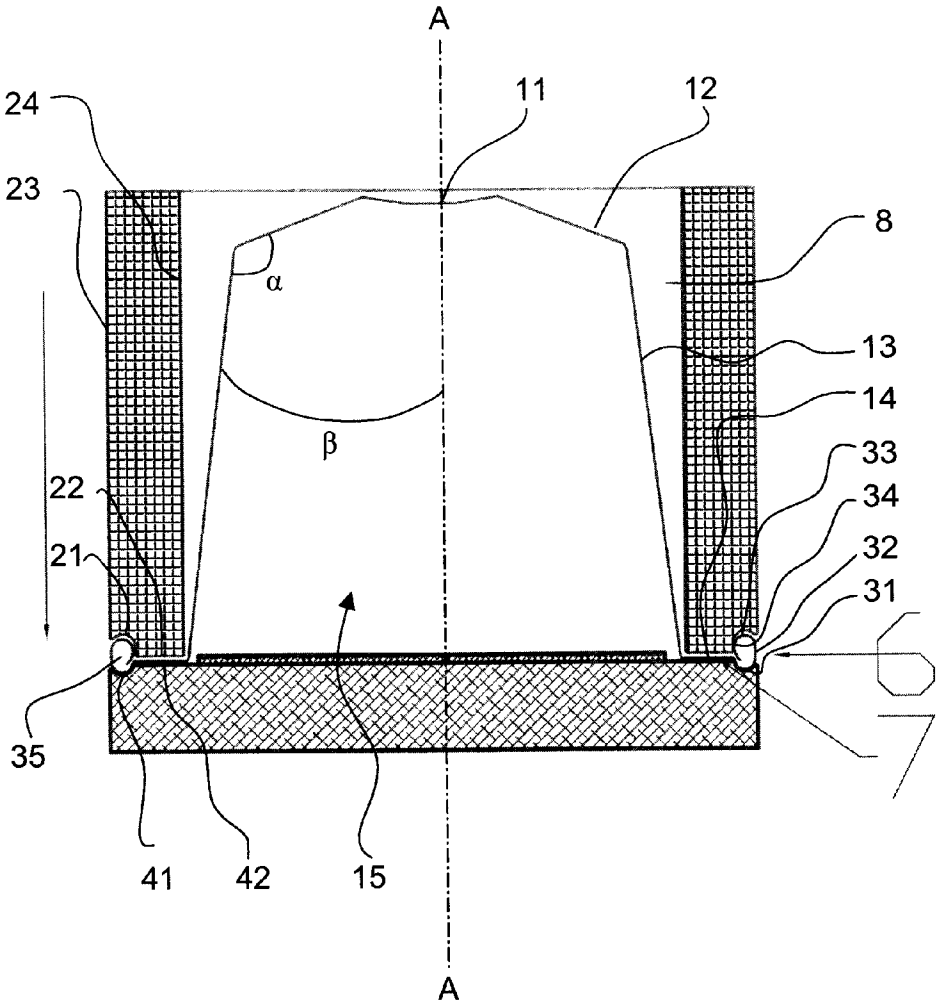
FIG. 3 shows the exemplary embodiment of FIG. 1 during the extraction operation.

FIG. 3 shows the holding-down device 2 in its end position. If the holding-down device 2 is in this position, the drink can be extracted, here from the coffee powder. It can clearly be seen in this figure that the free-standing, fourth region 34 of the rollover edge has moved along the internal contour of the first region 31. This deformation of the rollover edge achieves fluid-tight contact between the holding-down device 2 and the counterpart 4. This produces a space 8 which is closed in a fluid-tight manner with respect to the environment.

It can be likewise be seen in FIG. 3 that there is a spacing 7 between the protruding edge 14 of the coffee capsule 1 and the lower edge 22 of the holding-down device. There is no contact between the lower edge 22 of the holding-down device 2 and the protruding edge 14 of the coffee capsule 1. The spacing 7 preferably has a height of 0.05 mm to 0.5 mm. A height of 0.1 mm to 0.3 mm is particularly preferred. The height extends from the surface of the protruding edge 14 as far as the lower edge of the holding-down device 2.

By pressurization of the space during the extraction of the drink, the increased pressure in the space 8 can spread through the spacing 7 as far as the rollover edge seal. In the process, the pressure can enter the interior space 35 of the rollover edge seal, with the individual regions then being deformed outwards. This deformation is limited by the holding-down device 2, the counterpart 4 and a mechanical outer element (not shown) which touches the second region 32 of the rollover edge. This deformation achieves particularly effective sealing.

The holding-down device 2 can be made movable using mechanical means and/or hydraulic means. In a preferred example, the holding-down device is first moved by way of a mechanical actuator, i.e., a cam, knee joint or other lever mechanism, followed by a final hydraulic closure. The final hydraulic closure is obtained by the holding-down device 2 comprising a movable piston forming at least the sealing region 21 and lower edge 22 of the device and mounted on a fixed support of the device.

LIST OF REFERENCE NUMBERS

1 Coffee capsule
2 Holding-down device
3 Sealing element, rollover edge of capsule, deforming seal
4 Counterpart
5 Punching plate
7 Spacing
8 Space
11 Base
12 Transition region
13 Side wall
14 Protruding edge
15 Cavity
21 Sealing region
22 Lower edge
31 First region
32 Second region
33 Third region
34 Fourth region

The invention claimed is:

1. A portion packaging for receiving a substance to produce a drink comprising a capsule having:

a cavity with an opening for receiving a substance and, a side wall at said opening, an outwardly protruding edge which is integrally formed on the side wall at said opening, a film, and a deformable sealing element which is integrally formed with the outwardly protruding edge, wherein said opening is closable by the film and wherein the deformable sealing element comprises a rollover edge having an essentially elliptical or oval cross-sectional shape defining an open interior cavity that facilitates deformation, and having a greater height than width, wherein at least a portion of the rollover edge is configured to be irreversibly deformed when producing the drink, and the rollover edge is integrally formed with a plurality of edge portions on an outer border of the protruding edge, with a first edge portion having a rounded shape and protruding downwards, a second edge portion being integrally formed on the first edge portion such that the second edge portion is arranged essentially at right angles to a surface of the protruding edge, a third edge portion being integrally formed on the second edge portion and having a rounded shape, and a fourth edge portion being integrally formed on the third edge portion with the fourth edge portion extending essentially parallel to the second edge portion and either being connected to the outer border of the protruding edge as said sealing element is deformed or being free-standing when said sealing element is not deformed, the fourth edge portion comprising a free end configured such that deformation of the deformable sealing element surrounds the free end by the four edge portions.

2. The portion packaging according to claim 1, wherein the rollover edge of the deformable sealing element is configured and dimensioned to be deformed by means of at least one of a holding-down device or a counterpart of a corresponding extraction device before or during an extraction operation in such a manner that a fluid-tight contact can be produced between the holding-down device or the counterpart and the sealing element.

3. The portion packaging according to claim 2, wherein the rollover edge of the deformable sealing element is configured and dimensioned to provide a spacing between a lower edge of the holding-down device and the protruding edge of the portion packaging after being deformed by the holding-down device when the holding-down device is closed.

4. The portion packaging according to claim 3, wherein the spacing has a height of 0.05 mm to 0.5 mm, extending from the protruding edge of the portion packaging to the lower edge of the holding-down device.

5. The portion packaging according to claim 4, wherein the sealing element is arranged on an outer border of the protruding edge.

6. The portion packaging according to claim 5, wherein the rollover edge is integrally formed on the outer border of the protruding edge, and in that the rollover edge extends upwards or downwards from the protruding edge and has one edge portion that assumes an essentially round cross-sectional shape.

7. The portion packaging according to claim 1, wherein the portion packaging is made from aluminum or an aluminum alloy.

8. The portion packaging according to claim 7, wherein the portion packaging includes a layer of plastic.

9. The portion packaging according to claim 1, wherein the portion capsule has an average wall thickness of 0.05 mm to 0.12 mm.

10. The portion packaging of claim 7 wherein the aluminum or aluminum alloy and rollover edge are shaped by a deep-drawing process.

11. The portion packaging of claim 7 which further comprises in the cavity a substance to produce a drink and the film that closes the opening of the cavity retains the substance in the cavity.

12. A device for producing a drink by extraction of same from a substance contained in a portion packaging according to claim 1, the portion packaging being insertable into the device, the device comprising;

at least one holding-down device; and a counterpart with a punching plate, the holding-down device comprises a first depression that has an oval shape that is complementary to an upper portion of the deformable sealing element and positioned for producing a sealing deformation, the counterpart comprises a second depression that has an oval shape that is complementary to a lower portion of the deformable sealing element, the first and second depressions are aligned concentrically with each other and are configured to irreversibly deform at least a portion of the rollover edge of the sealing element of the portion packaging either before or during the extraction operation so that a fluid-tight contact can be produced between the holding-down device or the counterpart and the sealing element, and wherein the deformable sealing element is configured and dimensioned to provide a spacing between a lower edge of the holding-down device and the protruding edge of the portion packaging after being deformed by the holding-down device when the holding-down device is closed.

13. The device of claim 12 in combination with the portion packaging, wherein the portion packaging comprises: a cavity for receiving the substance.

14. A portion packaging for receiving a substance to produce a drink comprising a capsule having:

a wall member shaped to form an open cavity for receiving a substance and including an outwardly protruding flange that includes a deformable sealing element which is integrally formed with a peripheral edge of the flange; and a film that contacts the flange to close the open cavity and wherein the deformable sealing element is peripherally spaced from the cavity opening and comprises a rollover edge of the flange having an essentially elliptical or oval cross-sectional shape defining an open interior cavity that facilitates deformation, with the shape of the flange of the rollover edge having a height that is between 1.25 and 6 times greater than that of the width and is spaced on the outwardly protruding edge by a distance of 1 to 5 mm from the side wall, such that the space between the cavity opening and sealing element is configured to receive a holding-down device or a counterpart of a corresponding extraction device before or during an extraction operation in such a manner that fluid-tight contact is achieved, wherein at least a portion of the rollover edge is configured to be irreversibly deformed when producing the drink, and the rollover edge is integrally formed with a plurality of edge portions on an outer border of the protruding edge, with a first edge portion having a rounded shape and protruding downwards, a second edge portion being integrally formed on the first edge portion such that the second edge portion is arranged essentially at right angles to a surface of the protruding edge, a third edge portion being integrally formed on the second edge portion and having a rounded shape, and a fourth edge portion being integrally formed on the third edge portion with the fourth edge portion extending essentially parallel to the second edge portion and either being connected to the outer border of the protruding edge as said sealing element is deformed or being free-standing when said sealing element is not deformed, the fourth edge portion comprising a free end configured such that deformation of the deformable sealing element surrounds the free end by the four edge portions.

15. A device for producing a drink by extraction of same from a substance contained in a portion packaging according to claim 14, the portion packaging being insertable into the device, the device comprising;

at least one holding-down device; and a counterpart with a punching plate, the holding-down device comprising a first depression that has an oval shape that is complementary to an upper portion of the deformable sealing element and positioned for producing a sealing deformation, the counterpart comprising a second depression that has an oval shape complementary to a lower portion of the deformable sealing element, the first and second depressions are aligned concentrically with each other and are configured to irreversibly deform at least a portion of the rollover edge of the sealing element of the portion packaging either before or during the extraction operation so that a fluid-tight contact can be produced between the holding-down device or the counterpart and the sealing element, and wherein the deformable sealing element is configured and dimensioned to provide a spacing between a lower edge of the holding-down device and the protruding edge of the portion packaging after being deformed by the holding-down device when the holding-down device is closed.

16. The device according to claim 15, wherein, during the deformation operation, the fourth edge portion is urged into the rounded shape of the first edge portion.

17. The portion packaging according to claim 1, wherein the rollover edge has a height that is between 1.25 and 6 times greater than that the width and is spaced on the outwardly protruding edge by a distance of 1 to 5 mm from the side wall.

* * * * *